US005899159A

United States Patent [19]

Dasher et al.

[11] Patent Number: 5,899,159

[45] Date of Patent: May 4, 1999

[54] METHOD OF FORMING A FOLDED HEM AND SYSTEM FOR GUIDING A MULTIPLE PLY SEAM OF A TEXTILE WORK PIECE

[75] Inventors: Preston B. Dasher; John S. Chamlee, both of Lawrenceville; Tadeusz Olewicz, Hoschton, all of Ga.

[73] Assignee: Atlanta Attachment Company, Lawrenceville, Ga.

[21] Appl. No.: 08/982,653

[22] Filed: Dec. 2, 1997

[51] Int. Cl.[6] ..... D05B 35/04; D05B 35/10

[52] U.S. Cl. ..... 112/475.03; 112/63; 112/306; 112/143; 112/475.06; 226/17

[58] Field of Search ..... 112/470.07, 475.03, 112/475.02, 475.06, 470.16, 63, 153, 306, 318, 322, 277, 305, 475.04, 141, 143; 226/15, 17

[56] References Cited

U.S. PATENT DOCUMENTS

| | | | |
|---|---|---|---|
| 3,736,395 | 5/1973 | Farrar et al. | 112/203 |
| 3,970,014 | 7/1976 | Chano et al. | 112/121.11 |
| 4,098,201 | 7/1978 | Adamski, Jr. et al. | 112/2 |
| 4,098,204 | 7/1978 | Kojima | 112/121.12 |
| 4,359,953 | 11/1982 | Martell et al. | 112/121.11 |
| 4,479,447 | 10/1984 | Rohr | 112/141 |
| 4,924,790 | 5/1990 | Kondo et al. | 112/277 X |
| 5,161,476 | 11/1992 | Suzuki | 112/306 X |
| 5,269,257 | 12/1993 | Yamazaki | 112/306 X |
| 5,271,347 | 12/1993 | Fontcuberta | 112/153 X |
| 5,383,410 | 1/1995 | Mukai et al. | 112/63 |

*Primary Examiner*—Peter Nerbun

*Attorney, Agent, or Firm*—Womble Carlyle Sandridge & Rice

[57] ABSTRACT

A guiding system for use with translucent textile work pieces is disclosed. A free edge (52) of a tubular work piece extends along a continuous processing path and is folded under the work piece to form a hem in the work piece. The work piece is then advanced along the processing path toward a downstream sewing machine (11), whereupon the hem is sewn in the work piece. A lower ply sensing opposed beam sensor (76) upstream of the sewing machine detects a multiple ply leading edge of the folded hem, and is moved by a pneumatic cylinder (88) into a position laterally with respect to the processing path where it will detect the free edge of the folded and sewn hem, and will control a lower work piece guide assembly (34) so as to maintain a proper depth of the hem. This enables the sewing needles (20) of the sewing machine to align the two spaced parallel lines of stitching (68) at the beginning and end of the hem line for minimizing waste in such hem forming operations.

23 Claims, 7 Drawing Sheets

METHOD OF FORMING A FOLDED HEM AND SYSTEM FOR GUIDING A MULTIPLE PLY SEAM OF A TEXTILE WORK PIECE

FIELD OF THE INVENTION

This invention relates to a method and apparatus for detecting and guiding an edge of a textile work piece toward a finishing station, such as to a sewing machine, after the edge portion of the work piece has already been formed into a folded hem or otherwise attached to or superimposed on an adjacent ply of material. More particularly, this invention provides a system for detecting the edge of a work piece through another ply of material as the work piece advances toward a finishing station, and in response to the detection of the edge, for guiding the edge of the work piece through the finishing station.

BACKGROUND OF THE INVENTION

In the production of garments and other textile products in a high volume industrial assembly process in which the work pieces are sewn together, it is important that the sewing equipment provided to the worker be fast and efficient in its operation, and also that the equipment be capable of being quickly and easily loaded with the work pieces by the worker. Further, it is highly desirable that once the work pieces have been properly loaded in position, and the equipment placed in operation, that the equipment accurately form the desired work piece without errors so that the production of "seconds" is avoided.

In the production of garments and other items which are to be purchased as high quality goods, therefore, it is important that the hems and seams connecting the adjacent work pieces be accurately formed, as by the stitching for a hem extending through the edge portion at the raw edge of a folded hem, rather than allowing the stitching to wander off or away from the edge portion. In those instances where a line of stitching in a continuous hem overruns and merges with itself at the beginning and end of the line of the stitching, it is important that the end of the line of stitching and the beginning of the line of stitching be closely aligned with one another. If the beginning and end of the line of stitching are misaligned where they overlap, an undesirable visual appearance will be created and it is likely that the garment will be considered a "second" and refused by the potential purchaser.

For example, when a folded hem is formed at the waist line of a tubular knitted shirt the typical and desirable stitch formation comprises two lines of parallel stitches formed on the external surface of the garment, with connecting stitches on the rear surface holding the former raw edge portion of the hem in place. It is important, then, to make sure that the parallel stitches at the beginning and at the end of the run of stitches about the garment are aligned as they overlap to create a pleasing visual appearance.

The prior art automated work piece guide systems that form hems in the continuous edges of tubular garments, such as the waist hem of a knitted shirt, do not have the consistent ability to align the work pieces with the sewing machine so that overlapping stitches at the beginning and end of a stitch run are aligned. Also, the line, or lines, of stitching may not be aligned with the raw edge in the hem of the garment because the depth of the hem might vary along its length. These problems seem to be generated because the known prior art devices first guide the unfolded raw edge along the processing path until the edge portion is folded over onto the adjacent body portion to form the hem, and then guide the folded edge of the hem along the processing path to a downstream sewing machine.

A guide system of this general type is disclosed in U.S. Pat. No. 4,497,447. If the tension changes in the work piece during the operation of the equipment, or if the folder does not function perfectly, the depth of the folded edge portion of the hem may vary along the length of the hem causing the raw edge of the garment to wander out of alignment with the stitches as the garment advances through the sewing machine. Moreover, when the sewing of the hem in the work piece begins, the alignment of the work piece and the depth of the fold may not be as accurate at the beginning of the sewing cycle as it will be during the middle and end portions of the cycle, so that the line of stitches formed at the beginning of the stitching function may be displaced to one side or the other of the desired stitch track. In this situation, the beginning and ending stitches of an overlapping stitch run may be misaligned and form an undesirable appearance.

What is needed, therefore, but seemingly unavailable in the art is a guiding system for use with multiple ply seam textile work pieces which will repeatedly, accurately, and quickly guide the folded raw edge portion of a work piece toward a hem forming station, for example, to ensure that a uniform hem is sewn into the work piece, and which will ensure that the lines of stitching remain parallel to and aligned with one another along the raw edge of the work piece.

SUMMARY OF THE INVENTION

Briefly described, the present invention comprises an improved method and apparatus for accurately guiding an edge of a multiple ply textile work piece as it advances along a processing path toward a downstream sewing machine, or other work station. The invention can guide both the raw edge and the folded edge of the work piece along a processing path toward and in alignment with the downstream work station. The raw edge of the work piece will typically be an unfinished edge of a ply of a textile material which overlies another ply of the material, and results from the folding of the raw edge portion of the work piece over onto the body of the work piece to form a folded, hemmed edge of the work piece. The raw edge of the work piece will thereafter be sewn to the body of the work piece to complete the formation of the hem. The plies of textile work pieces generally are somewhat translucent, and an optical detector array is provided which is constructed and arranged to read through the plies of material, and to detect the hidden or raw edge of the hem. An edge responds to the detection of the hidden or raw edge of the hem to adjust the lateral position of the work piece with respect to its length as the work piece advances along the processing path through a sewing machine forming the hem, for example.

In a preferred embodiment of the invention, the free or raw edge of a tubular garment, such as a continuous waist edge of a knitted shirt blank, is advanced along a continuous processing path. While being advanced along the processing path the unfolded raw edge of the work piece is detected and is guided so that it is progressively folded over onto the adjacent body portion of the garment to form a folded hem, whereupon the raw edge is progressively sewn to the adjacent body portion of the work piece at a downstream sewing machine. Thereafter, a leading end of the now folded and sewn hem continues to advance along the processing path after being advanced through the sewing machine as the sewing cycle of operation is completed. The raw edge of the oncoming, folded, and sewn hem is detected through the adjacent body portion of the material by one of the optical detectors of the detector array, and in response to the detection thereof the raw edge is guided toward and into the sewing machine so that the raw edge becomes aligned with the remainder of the previously hemmed and sewn raw edge, and the lines of stitching forming the hem become aligned with one another to ensure that a properly finished work piece results, thus minimizing the prospect of sewing an unsatisfactory hem which may require discarding or re-sewing of the work piece.

In a preferred embodiment of the invention, therefore, the system for guiding and detecting the multiple ply seam, i.e. the hidden raw edge, of the work piece includes a spaced pair of ply sensing opposed optical beam sensors. A first opposed optical beam sensor is positioned along the processing path upstream of the hem folding guide of the sewing machine to detect a single ply of the work piece before the hem or other multiple ply structure has been folded in the work piece. A second opposed optical beam sensor is positioned along the processing path downstream of the folder and the sewing machine so as to detect a multiple thickness of the overlapped plies in the hem of the work piece after the hem has been folded and sewn therein. A control circuit, which includes a sensor amplifier, is provided to measure the intensity of the light emitted and detected through the single ply of the work piece by the first opposed beam sensor, which light reading is used to calibrate a "light" or first condition within the sensor amplifier. The same electrical circuit is used with the second opposed beam sensor to measure the intensity of the light emitted through the multiple ply hem of the material, which light reading is then used to calibrate a "dark" or second condition within the sensor amplifier such that it can conduct a comparison function.

Once the light intensity calibrations are made of the textile fabric for a single cycle of the system, i.e. the sewing of a hem in a single work piece, the amplifier has thus become calibrated and a relay selectively switches back to the emitted light intensity signal of the first opposed beam sensor and waits for the next work piece to be placed on the hemming machine. Accordingly, the first opposed beam sensor is then moved into a new position laterally with respect to the processing path and in registry with the raw edge of the folded, sewn hem so that it now will detect the difference between one ply, and multiple plies, of the same fabric due to the observed light condition. When the raw edge in the folded, sewn hem is detected by the amplifier, due to a change from the first or "light" light intensity to a second or "dark" light intensity, the amplifier emits a light intensity control signal to a machine controller, which in turn operates spaced upper and lower edge guides to align the folded unsewn raw edge with the hemmed "raw" edge of the work piece.

The comparison of the light intensities emitted and detected through the multiple plies versus the single ply of the work piece assures that when the raw edge of the work piece is first folded and sewn into a hem by the sewing machine of the hemming station, and the folded hem continues to advance along the processing path back toward the sewing machine, it will pass the first opposed beam sensor a second time whereupon the first sensor will accurately detect the hidden edge, the folded raw edge, in the hem of the work piece. The lateral guide system of the invention responds to this detection of the raw edge and guides the raw edge toward and into the sewing machine in alignment with the raw edge position detected by the first opposed beam sensor and to ensure that the stitches in the hem remain parallel to and aligned with one another along the raw edge.

The automatic comparison/calibration function of the invention performed each time a new work piece is run permits the optical detectors of the sewing system to adjust not only to changes in ambient conditions at the detectors, for example the build up of dust or lint thereon after repeated sewing cycles, but also to adjust to different fabrics which may tend to emit different light intensities therethrough, without requiring manual adjustment of the detectors. For example, when different types of work pieces are mounted on the machine, for example a second work piece having a different thickness than the previous work piece, or a work piece of a light color as opposed to a dark color, for example yellow versus blue, the system makes its own adjustment for the light intensity emitted through the single and multiple plies of the work pieces without interruption of the finishing operation and without requiring recalibration of the sensors.

It is, therefore, an object of the invention to provide an improved system for guiding a multiple ply seam of a textile work piece toward a downstream processing station as the work piece advances along a processing path.

Another object of the invention is to provide an improved method and apparatus for guiding the folded hem of a tubular work piece, for example a continuous waist edge of a knitted shirt or the like, toward a downstream finishing station.

Yet another object of the invention is to provide an improved guiding system for detecting the raw edge of a multiple ply folded hem as the hem advances toward a sewing machine, and guiding the raw edge toward and through the sewing machine.

Still another object of the invention is to provide an improved guiding system that optically detects a hidden edge of a work piece, and guides the hidden edge toward a downstream processing station, for example a sewing machine, in alignment with the hem being sewn into adjacent plies of material.

Another object of the invention is to provide an improved edge guiding system which optically detects a hidden edge of a textile work piece as the work piece advances toward a finishing station, and which automatically adjusts the sensitivity of the optical detection of the hidden edge for each cycle of the system in response to a change in light emissions passing through the work piece.

Other objects, features, and advantages of the present invention will thus become apparent by reading the following specification, when taken in conjunction with the accompanying drawings.

DETAILED DESCRIPTION

Figure 1:
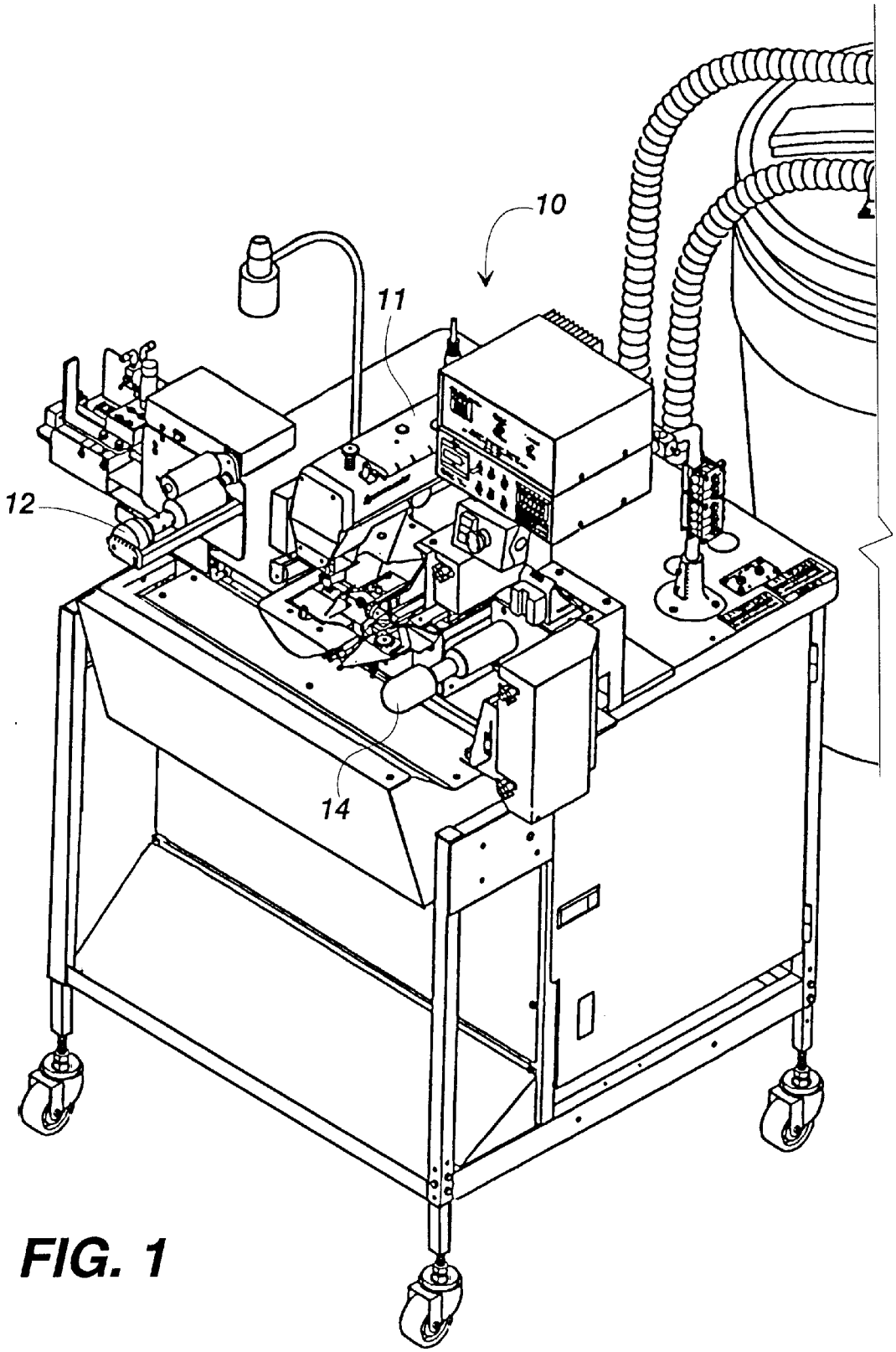
FIG. 1 is a perspective illustration of a bottom hemmer used for sewing hems in tubular textile work pieces.

Referring now in more detail to the drawings, in which like reference numerals indicate like parts throughout the several views, FIG. 1 illustrates a bottom hemmer 10 used to sew hems in textile work pieces. The bottom hemmer includes a sewing machine 11, which is a conventional sewing machine of a type known to those skilled in the art used to sew hems into textile work pieces. The novel system for guiding a multiple ply seam of a textile work piece of this invention is used with bottom hemmer 10, and is constructed and arranged to guide a multiple ply hem of a textile work piece W (FIGS. 5–8) along a processing path "P" toward a downstream processing station, for example sewing machine 11, where the hem is sewn into the work piece.

The bottom hemmer includes a pair of spaced, parallel rotatable guide spindles 12, 14, which are constructed and arranged to advance the work piece in a continuous looped processing path through the sewing machine. In use, the tubular body (not illustrated) of the work piece is passed over the spindles and the spindles moved away from one another to tension the work piece before the sewing operation is begun.

Figure 2A:
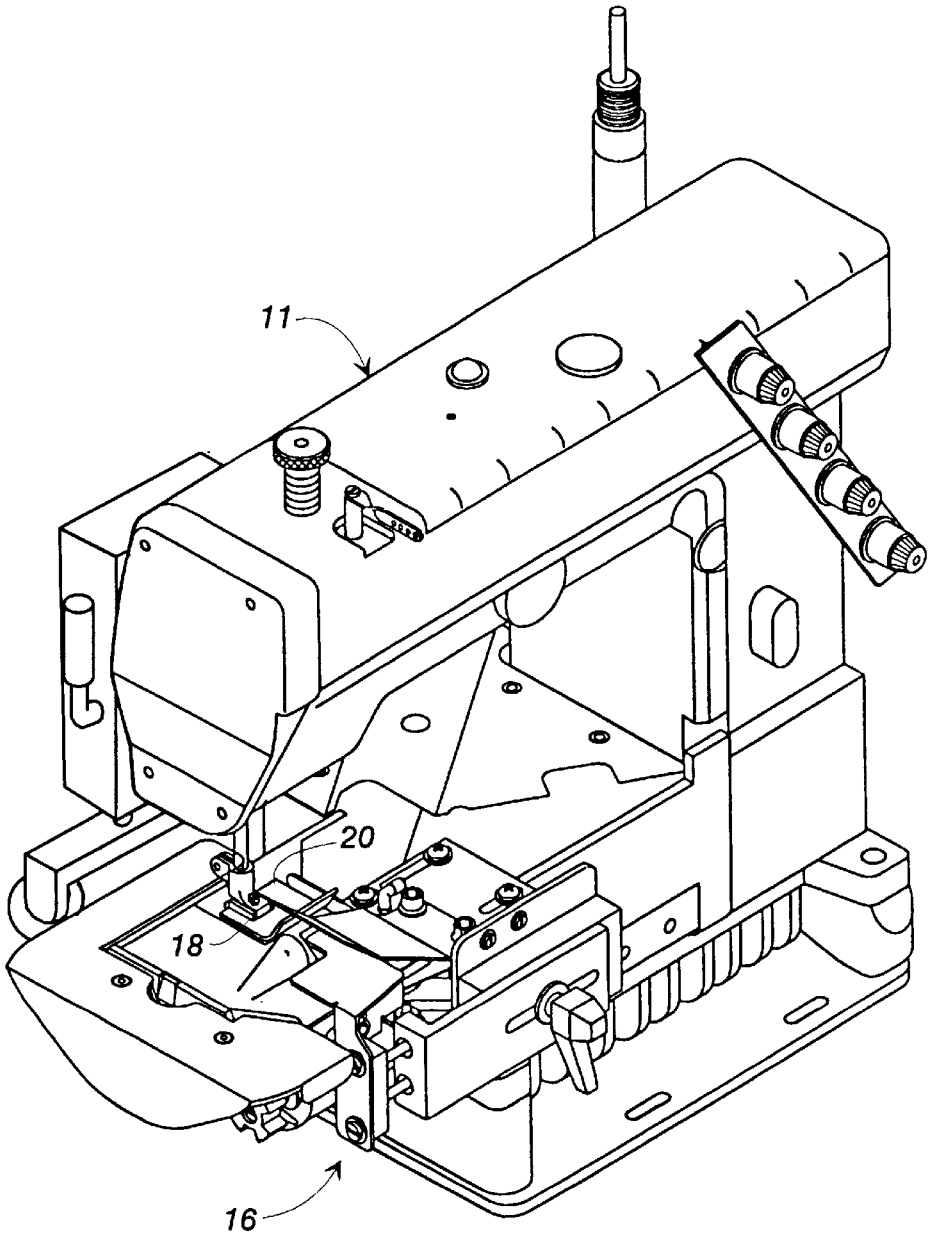
FIG. 2A is a perspective view of a sewing machine and a hem folder assembly provided as a part of the bottom hemmer of FIG. 1.
Figure 2B:
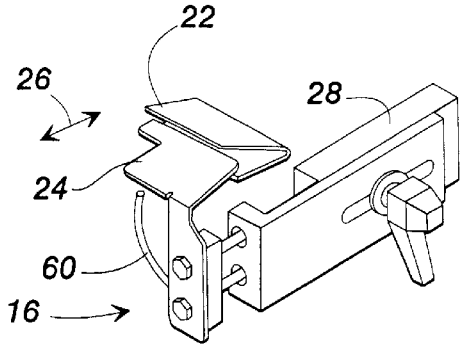
FIG. 2B is a separate perspective view of the hem folder assembly of FIG. 2A.

As shown in FIGS. 2A and 2B, a hem folder assembly 16 is mounted to the housing of sewing machine 11, upstream of a presser foot 18 and the needles 20 of the sewing machine. The folder assembly includes a stationary U-shaped guide 22 (FIG. 2B) and a movable tongue 24 that is supported for selective reciprocating movement into and out of the crotch of the U-shaped guide, as indicated by the double-headed arrow 26 in FIG. 2B. A pneumatic cylinder 28, operated by a machine controller (not illustrated) including a computer (not illustrated) and a control program (not illustrated) stored therein controls the movement of tongue 24 into and out of the U-shaped guide.

Figure 3:
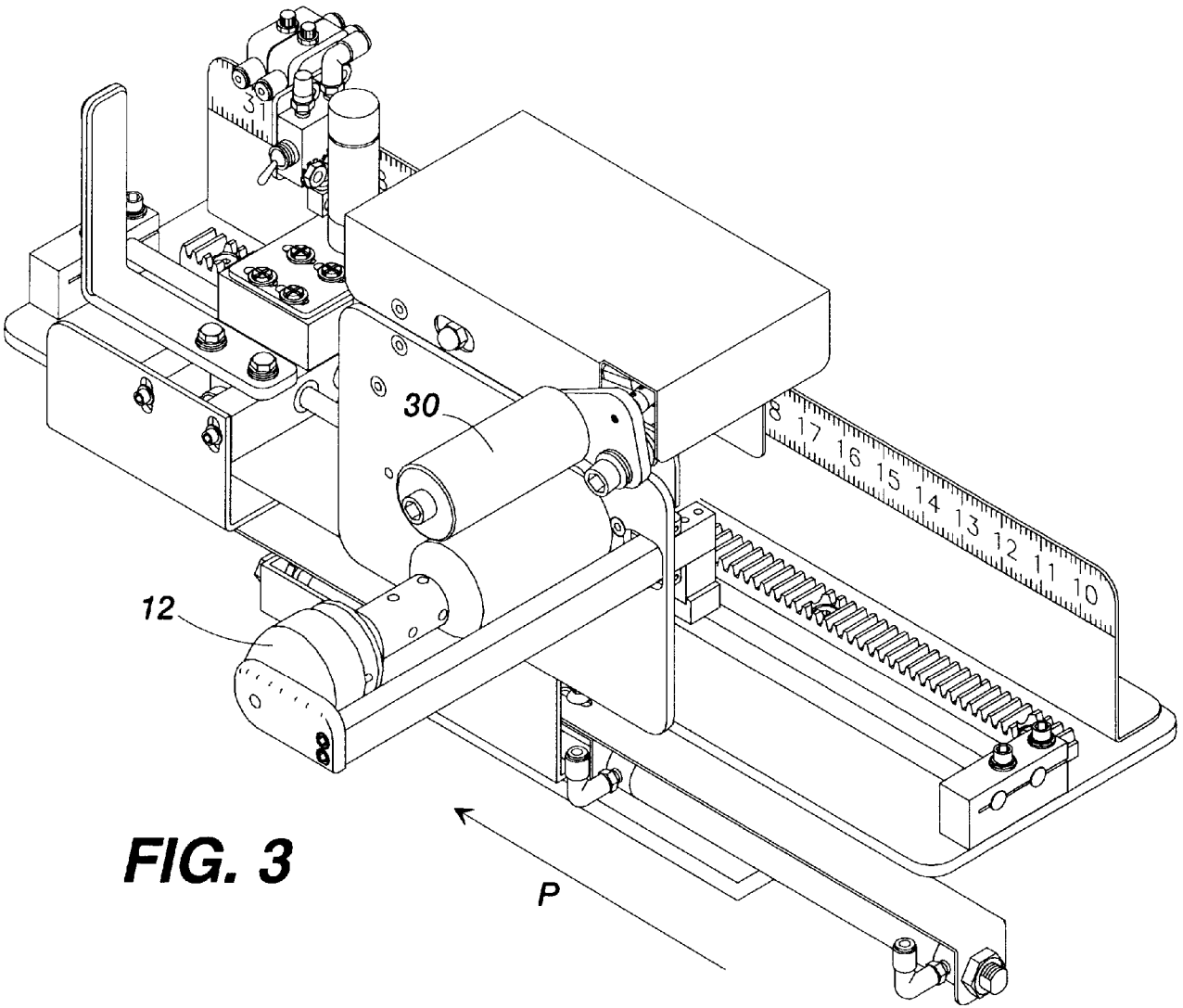
FIG. 3 is a perspective view of a downstream spindle and drive system used with the bottom hemmer of FIG. I to advance an edge portion of a work piece along a processing path.

Guide spindle 12, the downstream guide spindle, is illustrated in more detail in FIG. 3 which illustrates the downstream spindle and drive assembly used to advance the work piece along the closed processing path (FIGS. 5–8). A clamp roller 30 is mounted on the assembly, and is constructed and arranged to move in an arc toward and away from spindle 12 so that it may grip the work piece against the spindle. As desired, either spindle 12 or clamp roller 30 will be driven by an electric motor (not illustrated), as well as a suitable drive train arrangement (not illustrated) so as to advance the work piece along the processing path. The motor (not illustrated), clamp roller, spindle 12, and upstream spindle 14 (FIGS. 1, 4) thus function as the drive used to advance the edge portion of the work piece through sewing machine 11 as the hem is sewn therein. The position of guide spindle 12 and clamp roller 30 along the processing path can be adjusted linearly along the processing path, in known fashion, so that the guide spindle may be positioned closer to, or farther away, from sewing machine 11 to allow the bottom hemmer to accommodate larger or smaller textile work pieces. Although not shown in specific detail in FIGS. 1–8, the work pieces being placed on bottom hemmer 10 will first have been formed into tubular work pieces by having a side hem sewn along its side edge, or edges, and typically will have a top or neck portion and a bottom or waist portion. Bottom hemmer 10 forms the hem in the bottom portion of the work piece.

Figure 4:
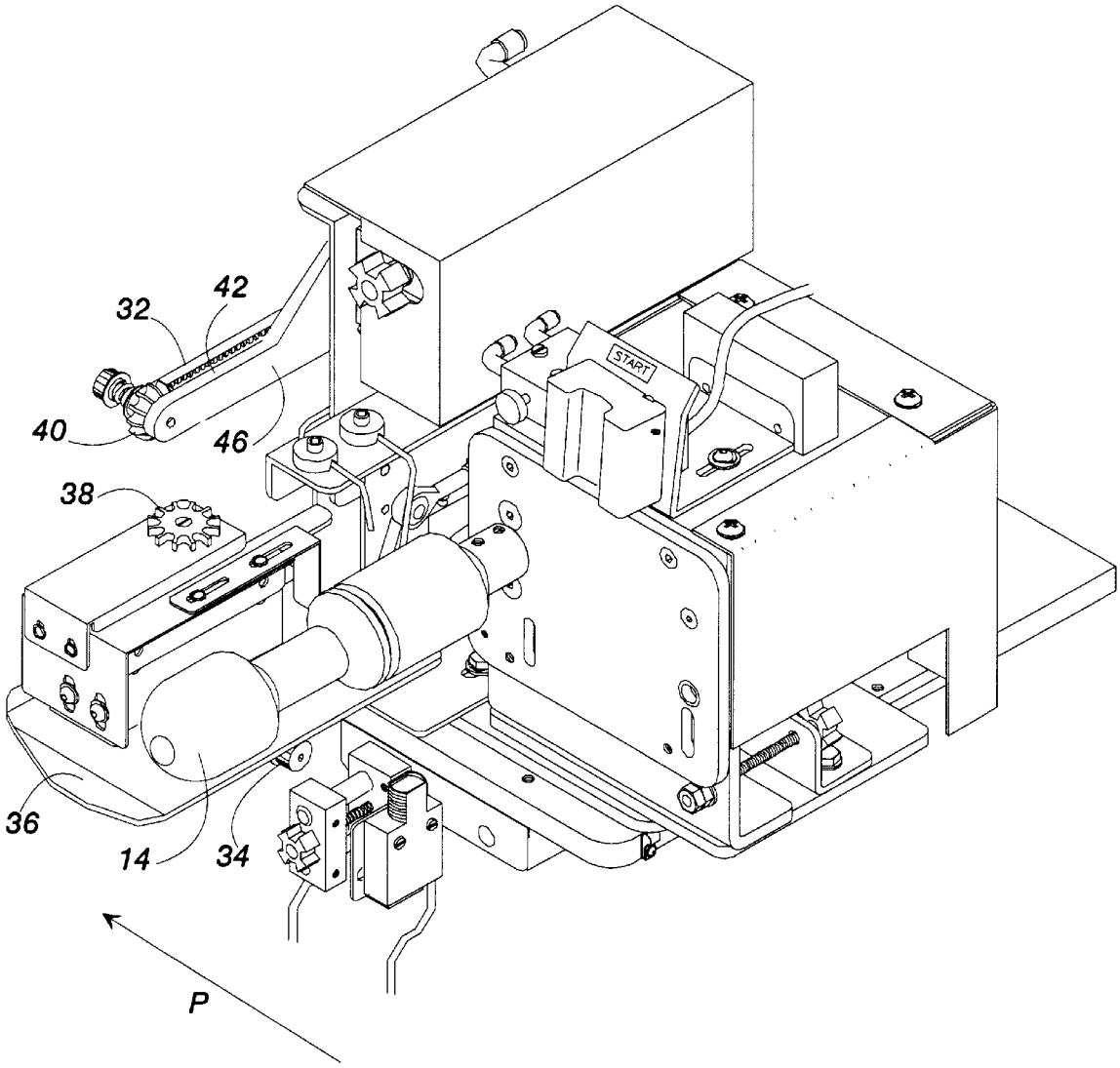
FIG. 4 is a perspective illustration of an upstream turning spindle and the accompanying lateral work piece guides of the bottom hemmer of FIG. 1 used with both the top and bottom runs of a work piece as it advances along a processing path toward the sewing machine of the bottom hemmer.

Referring now to FIG. 4, guide spindle 14, the upstream guide spindle, is provided as a part of the upstream guide spindle assembly and is positioned so as to receive and turn the work piece from the lower return run "L" (FIGS. 5–8) back toward the sewing machine 11 along the processing path. Accordingly, an upper lateral work piece guide assembly 32, and a spaced parallel lower lateral work piece guide assembly 34 are mounted on a support plate 36 that extends in between the upper "U" and lower runs of the work piece. The two work piece guides are substantially identical in construction, and each includes an idler star wheel 38 mounted in a fixed position and rotatable along its vertically oriented central axis, with teeth radiating from its central axis adapted to pinch the work piece against a drive wheel 40. Drive wheel 40 is rotatable about a laterally oriented central axis, and is driven in known fashion by a timing belt 42 and a reversible motor (not illustrated).

Drive wheel 40 is positioned at the distal end of an elongate support arm 46 which is pivotable about its proximal end so as to move the drive wheel 40 in an arc toward and away from the teeth of the star wheel. When the drive wheel is moved toward and into engagement with the star wheel, and a textile work piece is being advanced between the star wheel and drive wheel, the drive wheel can be rotated so as to pull or push a textile work piece laterally across the processing path of the work piece such that the work piece position is adjusted with respect to sewing machine 11, and in particular presser foot 18 and needles 20 thereof, and the work piece is guided toward and into the sewing machine. Both the upper and lower lateral work piece guides are disclosed in more detail in U.S. Pat. No. 5,562,060, the provisions of which are incorporated herein by this reference. Also, the operation of both of the work piece guide assemblies 32, 34 are controlled by the machine controller (not illustrated), in known fashion.

FIGS. 5–8 sequentially illustrate the formation of a bottom hem in a textile work piece W. Once the work piece has been placed about spindles 12, 14, it has an upper run U, and a lower run L, as discussed above. The upper run is that portion of the work piece which advances along the processing path from upstream guide spindle 14 toward downstream guide spindle 12, whereas the lower run is that portion of the work piece which passes along the processing path from the drive spindle back toward the upstream guide spindle 14. As shown in FIGS. 5–8, therefore, a work piece W, for example a tubular knitted shirt having a continuous loop unfinished or "raw" edge 52, is placed about spindles 12 and 14, with the spindles initially being moved laterally with respect to each other, prior to the start of sewing operations, to stretch or tension the edge of the garment to a desired tension level.

At the beginning of the cycle of operation, spindle 12 is rotated to advance the edge portion 52 of the work piece along the processing path P as indicated by arrows 56 and 58, which correspond to the upper and lower runs, respectively, of the processing path. The tongue 24 of the folder assembly 16 (FIG. 2B) is urged into its U-shaped guide 22 to begin the folding of the work piece. In order to guide the raw edge 52 of the work piece W, a series of edge detectors are placed along the processing path. The lateral work piece guide assemblies 32 and 34 respond to the detection of the raw edge by the edge detectors, and folder tongue 24 operates in response thereto. Accordingly, a first edge detector 54 is positioned along the upper run of the processing path upstream of the sewing machine needles 20 in a position where it will detect the unfolded edge portions 72 of the work piece as it is advancing properly along the processing path toward the needles.

A second or folded raw edge detector 60 is positioned between the upper and lower runs of the work piece, beneath folder 16, and upstream of the sewing machine needles 20. This detector is positioned facing upwardly beneath the folder assembly to detect the reflection of light off of the tongue 24 so that when the raw edge portion of the work piece is folded beneath the adjacent body portion about folder tongue 24, the folded raw edge detector will now detect the raw edge of the work piece as it moves along the processing path toward needles 20 of the sewing machine, and indicates that the raw edge of the work piece has been properly folded under the adjacent body portion for forming the hem in the work piece. When the raw edge of the work piece covers the light reflection off of tongue 24, the folded raw edge detector 60 sees a dark condition whereupon the upper lateral work piece guide assembly 32 is engaged to urge the work piece laterally with respect to its length along the processing path to uncover the light reflection so that it may be seen by the raw edge detector 60. Likewise, when the raw edge uncovers the light reflection, and the raw edge detector 60 sees the light reflecting off of the tongue, the upper lateral work piece guide assembly 32 is then engaged to urge the work piece in the opposite direction laterally across the tongue to cover the light reflection. This results in a continuous, lateral, back and forth shifting motion of the work piece along the tongue 24 to maintain the raw edge in proper alignment as the work piece is advanced along the processing path on spindles 12, 14.

A third raw edge detector 62 is positioned along the lower run of the work piece, and is located so as to detect the unfolded raw edge 52 of the work piece on its lower run as it advances along the processing path between spindles 12 and 14. Detector 62 will detect the unfolded raw edge of the work piece, and control the operation of lower work piece guide assembly 34, in fashion similar to the control of the upper work piece guide assembly 32 by raw edge detector 60, for maintaining the raw edge of the work piece in proper alignment for being folded by hem folder assembly 16 as the work piece advances along the processing path about the two spindles.

More specifically, the second folded raw edge detector 60, and the third raw edge detector 62 control the upper and lower work piece guide assemblies 32 and 34, respectively, by rotating the respective drive wheels 40, which engage the work piece between the respective star wheels 38, to cause the work piece to move laterally as indicated by the double-headed arrows 66 and 67 in FIGS. 5–8. For example, if not enough of the textile material of the work piece is in the fold, or hem, of the work piece as formed by folder assembly 16, upper work piece guide 32 will rotate drive wheel 40 so as to urge more material to be run into the folder assembly, thereby increasing the depth of the fold that will form the hem of the work piece. When the detector 60 senses a change from light to dark, indicating that the raw edge is now past its optical alignment with needles 20 of the sewing machine, the rotation of drive wheel 40 of upper work piece guide 32 will reverse decreasing the depth of the folded hem. By this continual reversing of the drive wheel 40, the folded raw edge detector 60 will continuously see light and dark, and will thus continuously reverse the drive wheel 40. This will keep the raw edge 52 of the work piece located in an optical position along the processing path as the work piece advances toward the needles of the sewing machine. This operation is described in greater detail in U.S. Pat. No. 5,562,060, the provisions of which have been previously incorporated herein by reference.

The needles 20, and the opposed loopers (not illustrated) of the sewing machine 11 continuously form parallel lines of stitching 68 (FIGS. 5–8) along the adjacent body portion 70 which opposes the edge portion 72 of the folded hem. The opposite side of the hem is formed by the crossover stitches 74. The work piece can be aligned so that the crossover stitches are positioned to cover the raw edge of the work piece so that the raw edge is "hidden" in the folded and sewn hem.

A pair of ply sensing opposed optical beam sensors 76 and 78 are positioned on the lower return run, and upper run, respectively, of the work piece along the processing path. Opposed beam sensors 76 and 78 are identical in construction and each thus includes a U-shaped mount 80 with a light beam emitter 82 mounted on one leg of the mount, and a spaced light sensitive receiver 84 mounted on the other leg in alignment with emitter 82 of the mount. It is anticipated that the light beam emitter 82 will emit an infrared beam of light which will be received by receiver 84, although any optically detectable beam of light may be used, as desired. The U-shaped mounts 80 place the light beam emitter and the light receiver on opposite sides of the processing path, i.e. on the lower and upper runs of the work piece, respectively, along its edge portion so that the beams of light from the respective light emitters are directed through the edge portion 72 of the work piece, and the light receivers will sense the light emitted therethrough. Each of light sensitive receivers 84 will emit a light intensity signal for use in calibrating an amplifier 92 (FIG. 9), and for use by the amplifier and the control processing unit 96 of the machine controller (not illustrated) to control the respective work piece guide assemblies 32, 34, as discussed in greater detail below.

The first or lower ply sensing opposed optical beam sensor 76 is movably mounted between a first position (FIGS. 5, 6) to a second position (FIGS. 7, 8) laterally with respect to the processing path and straddles the return run, i.e. the lower run, of the work piece. A pneumatic cylinder 88 is provided as a part of the bottom hemmer assembly 10 (FIG. 1) and is arranged to shift the sensor 76 laterally back and forth across the edge portion of the work piece, as indicated by double-headed arrow 67. Cylinder 88 is controlled by the machine controller (not illustrated). The second or upper ply sensing opposed optical beam sensor 78 is mounted in a stationary position, and is constructed and arranged to detect the light emitted from its light beam emitter 82 through the folded hem portion of the work piece, which in this embodiment (FIGS. 5–8) comprises two plies of material, the edge portion 72 and the adjacent body portion 70 of the work piece. In other folded configurations, the hem might comprise more than two plies of material, as known to those skilled in the art.

Figure 9:
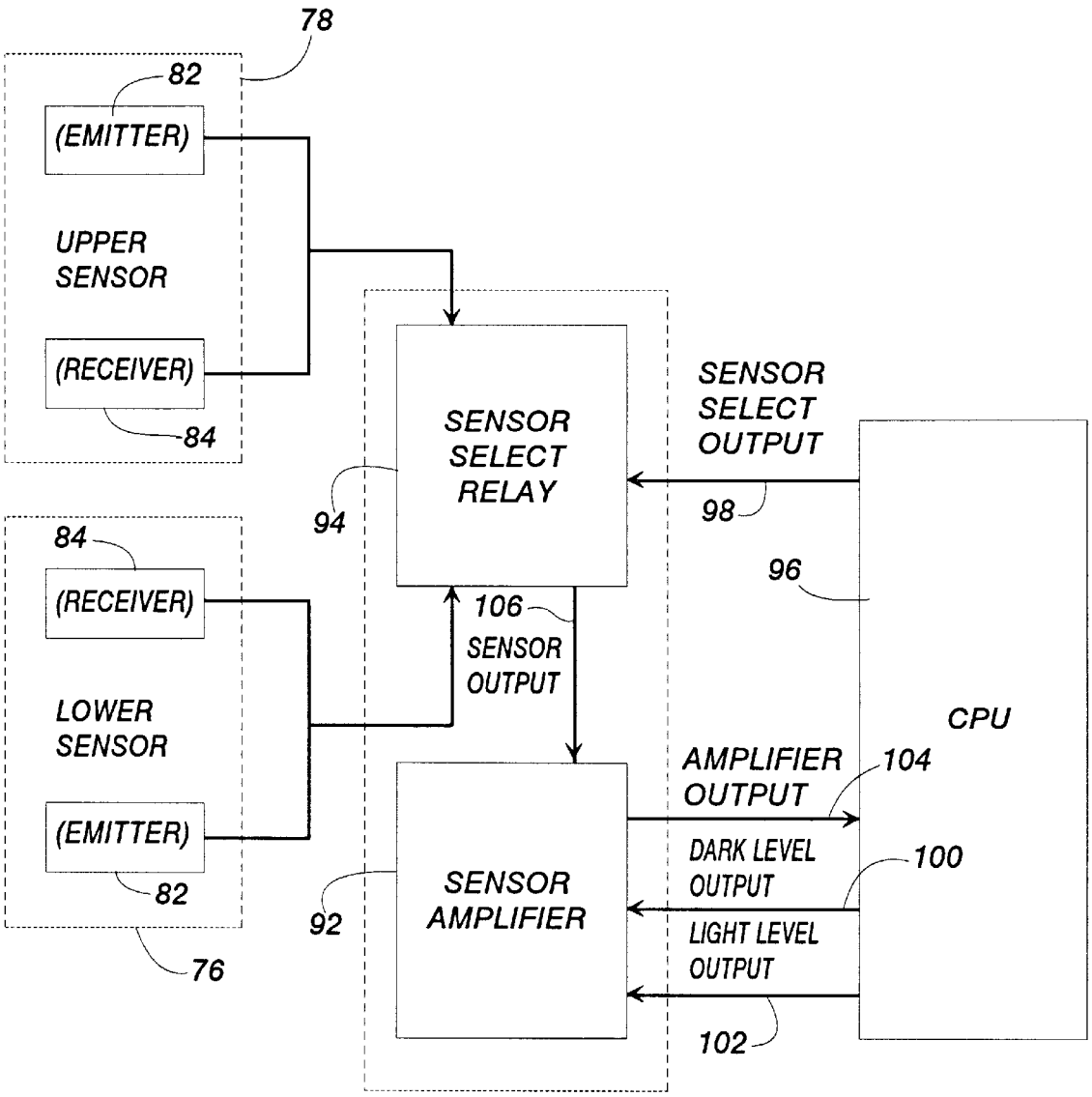
FIG. 9 is a circuit diagram of the electrical control system of the invention.

As shown in the circuit diagram of the electrical control system for bottom hemmer 10 of FIG. 9, each of the lower and upper opposed beam sensors 76, 78 includes an infrared light beam emitter 82, each of which emits a substantially identical intensity of infrared rays, and an opposed light beam received 84 in electronic communication with a sensor amplifier 92 through a select sensor relay 94. The relay is used to select which of the opposed beam sensors is connected to the amplifier for setting the sensitivity levels of the control system, and is controlled by the central processing unit 96 of the machine controller. Central processing unit 96 is provided as part of a conventional computer (not illustrated) which may comprise a microprocessor having an internal memory storage device or a separate memory and a memory read device, and executes the requisite control program used to automate the operation of the bottom hemmer 10 and the guiding system of this invention. Central processing unit 96 is provided with three outputs 98, 100, and 102 which control the relay and signal the amplifier, respectively, and an input line 104, the amplifier output, which reads the amplifier output into the central processing unit.

It is anticipated that the light beam emitter 82 and the light sensing receiver 84 of each one of opposed beam sensors 76 and 78, respectively, will be separate probes provided as a part of a probe set used with U-shaped mount 80 to construct the opposed beam sensors. As such, it is anticipated that the light beam emitting probe, and the light sensing receiving probe may be the model number UZH 200 probe set manufactured by Aromat, a subsidiary of Matsushita. Each of these separate probes is mounted onto the U-shaped mount 80, as described in the fashion above, to construct the respective opposed beam sensors. In addition, it is anticipated that the sensor amplifier 92 of FIG. 9, a programmable, and remote sensitivity setting type of amplifier, will be the model number UZG 130 amplifier, also manufactured by Aromat. A similar probe set is manufactured by Sunx, identified by its model number SH-21E, and a similar amplifier also is manufactured by Sunx, model number SU-77 amplifier. It is also anticipated, however, that other probe sets having light beam emitters, and light sensing receivers, as well as other programmable remotely sensitive amplifiers may be used, which either now exist, or may be developed in the future.

The "light" or first condition of the control system is established when a single ply of the work piece is passing through the lower opposed beam sensor 76. The sensor select output 98 is held in a "high" or first position by central processing unit 96, and turns relay 94 off. Once the relay is turned off, only the lower opposed beam sensor 76 is connected to amplifier 92 through sensor output line 106. The central processing unit then instructs an integrated programmable circuit and/or logic chip within the amplifier to read or measure the light intensity signal from the level of the light detected by lower opposed beam sensor 26, as emitted by its receiver 84, and passed through relay 94, and store this as the "light" or first condition of the work piece within the amplifier.

To calibrate the "dark" or second condition of the sensor amplifier 92, the sensor select output line 98 is held "low" by the central processing unit 96 to turn relay 94 on. With the relay on, only the upper opposed beam sensor 78 is connected to amplifier 92 through relay 94 and its sensor output line 106. The central processing unit then instructs the amplifier to read or measure the "dark" level signaled by upper opposed beam sensor 78, and stores the sensitivity for this "dark" or second condition within the amplifier. The amplifier is now calibrated for this work piece, and will signal to central processing unit 96 as to whether a "dark" or a "light" light intensity exists for operating the lower work piece edge guide assembly 34 in the fashion described in greater detail hereinabove, as the work piece continues to advance along the processing path.

A feature of this invention is that the calibration for the light and dark conditions are automatically set each time a new work piece is to be hemmed on bottom hemmer 10. Accordingly, as the control system calibrates itself each time a new work piece is placed on the machine and the sewing cycle started, the control system allows for consistent results in hem formation even though the sensors may become clouded or obscured by dust, lint or other debris over time, or even if work pieces or differing fabrics and/or colors are placed over the spindles 12, 14. For example, if a first work piece is made of a yellow material and a second work piece is made of a dark blue material, the light intensities emitted through the work piece may differ for each work piece. However, as the control system of the invention sets the "light" and "dark", i.e. the first and second, light conditions or sensor levels during each sewing cycle, the hem will be accurately guided through folder assembly 16 by the upper and lower work piece guide assemblies 32, 34 as needed. By enabling the system to detect, measure, and record dark and light conditions for each work piece, the system will accurately control the feeding of work pieces of differing weights, densities, and colors, without requiring the machine operator to stop and re-calibrate the system for each new run of work pieces, or even for work pieces within the same run if there are slight variations in material quality or coloration.

Figure 5:
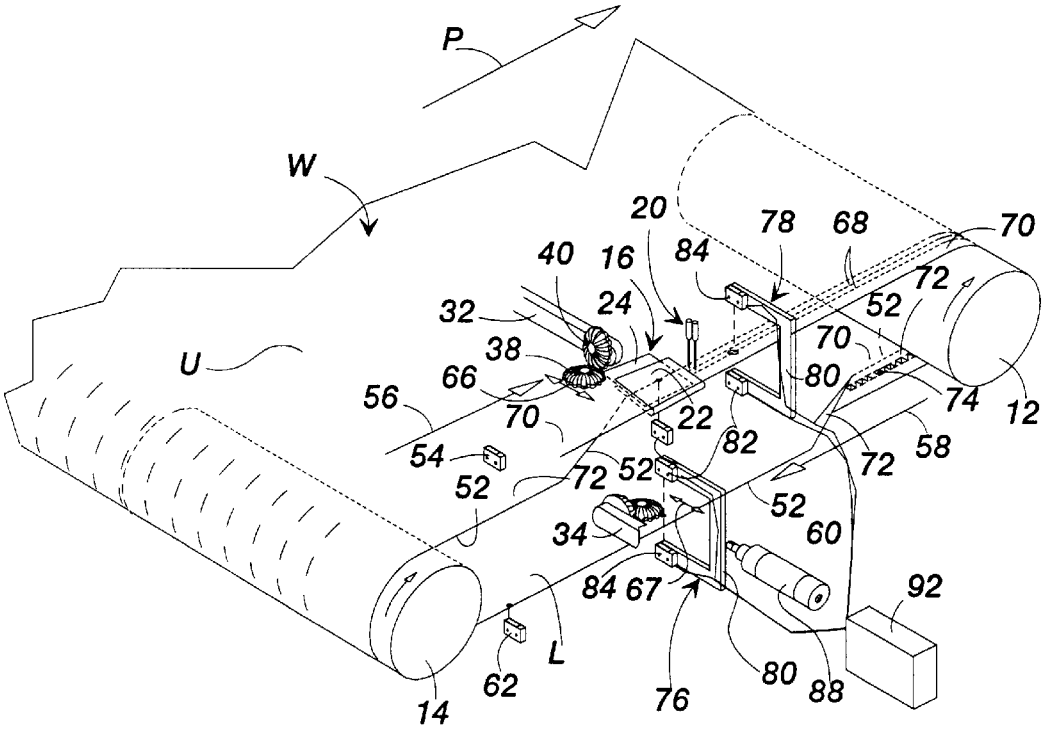
FIG. 5 is a first schematic perspective illustration of a preferred embodiment of the guiding system of the invention showing a textile work piece at the beginning of a sewing cycle with a first opposed beam optical sensor detecting a raw edge of the work piece, and a second downstream opposed beam optical sensor detecting the multiple plies of material of the hem sewn therein.

Referring now to FIG. 5, FIG. 5 illustrates the position of the work piece during the first one-third of the sewing cycle of bottom hemmer 10, also known as the "pre-sew" portion of the sewing cycle. Before the needles 20 of the sewing machine 11 are set into operation, the work piece is advanced about spindles 12 and 14 and along the processing path such that the raw edge 52 of the work piece passes into the folder assembly 16, whereupon the beginning of a hem is formed in the work piece by folding the edge portion 72 beneath the adjacent body portion 70. After the work piece has been progressively folded for a distance that extends through the sewing machine 11 such that the folded hem is stabilized for a pre-determined distance beyond the needles 20, sewing machine 11 is energized and needles 20 begin the formation of the parallel stitch lines 68, and crossover connector stitches 74, respectively, for sewing the bottom hem in the work piece.

As this process starts, sensor select relay 94 is connected to sensor amplifier 92 by central processing unit 96, which thus connects the sensor amplifier 92 to the lower opposed beam sensor 76. The lower opposed beam sensor will detect the amount of light that is emitted from the light beam emitter 82 through a single ply of material to its light sensitive receiver 84. This detected level of light intensity is passed on to the amplifier 92, and is used to set the "light" condition of the sensor amplifier 92 in response to an instruction to do so from central processing unit 96. The sensor relay, on instruction from central processing unit 96, then disconnects the amplifier from the lower opposed beam sensor 76, and connects the amplifier to the upper opposed beam sensor 78. As the upper opposed beam sensor 78 is located downstream of the needles 20, it reads through the now folded hem of the work piece, which in this instance has two plies of the work piece, although additional plies may be provided if the hem has been folded more than once. The reading from the upper opposed beam sensor is used to set the "dark" condition within sensor amplifier 92. The amplifier is thus calibrated prior to the start of a sewing operation so that when the lower opposed beam sensor 76 detects a light or one-ply condition, or a dark or a multiple ply condition which corresponds to the folded hem, sensor amplifier 92 will recognize the difference and will signal this to central processing unit 96, which in turn operates edge guide assemblies 32, 34, as needed, to maintain the alignment of raw edge 52 with the edge portion of the partially completed hem. During this first part of the sewing cycle, the pre-sew portion, unfolded raw edge detector 54 performs no function.

Figure 6:
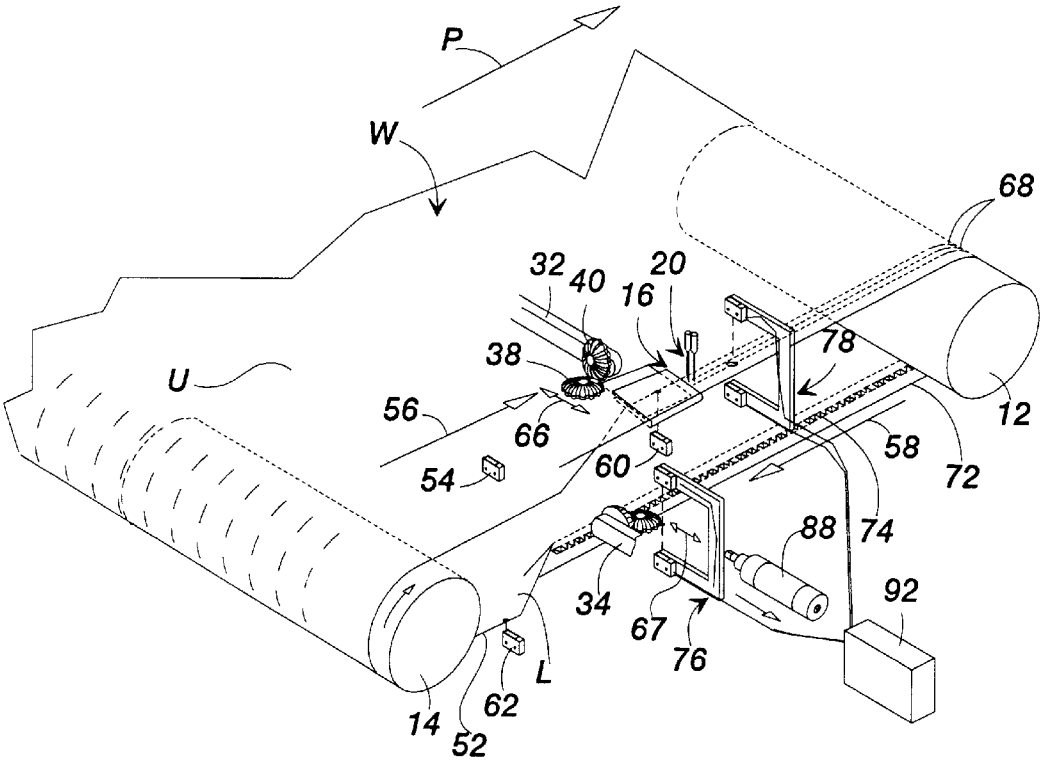
FIG. 6 is a second schematic perspective illustration, similar to FIG. 5, showing the partially sewn hem being advanced along the processing path during the sewing cycle, and showing the first opposed beam sensor detecting the oncoming sewn hem.

As illustrated in FIG. 6, lower opposed beam sensor 76 is initially held in a first position so that it will read through only a single ply of material, and is then later moved laterally to read through the multiple plies of the hem as the leading edge of the sewn hem reaches the position of the lower beam sensor. Thus, FIG. 6 shows the leading edge of the sewn hem reaching the lower opposed beam sensor 76 before the sensor has been shifted by pneumatic cylinder 88 into position for reading the folded plies of the work piece. Pneumatic cylinder 88 will progressively shift the U-shaped mount 80 of the lower ply sensing opposed beam sensor 76 farther inwardly of the folded edge of the work piece in response to the detection of the dark condition as it reads the multiple plies of material formed as a part of the hemmed work piece, to a second position which will be generally aligned with the folded raw edge 52 of the sewn hem (FIG. 3). The unfolded raw edge detector 62 which was controlling lower work piece guide 34 is now deactivated in response to the detection of the multiple plies of the work piece by the lower opposed beam sensor, and the lower opposed beam sensor takes over the control of the lower work piece guide assembly 34 in response thereto. As the lower opposed beam sensor signals the light and dark light conditions to amplifier 92, as determined by the amplifier, central processing unit 96 causes the lower work piece guide assembly 34 to shift the raw edge laterally with respect to the movement of the work piece along the processing path so that the raw edge of the work piece is always properly positioned along the processing path as the work piece advances about spindle 14.

Figure 7:
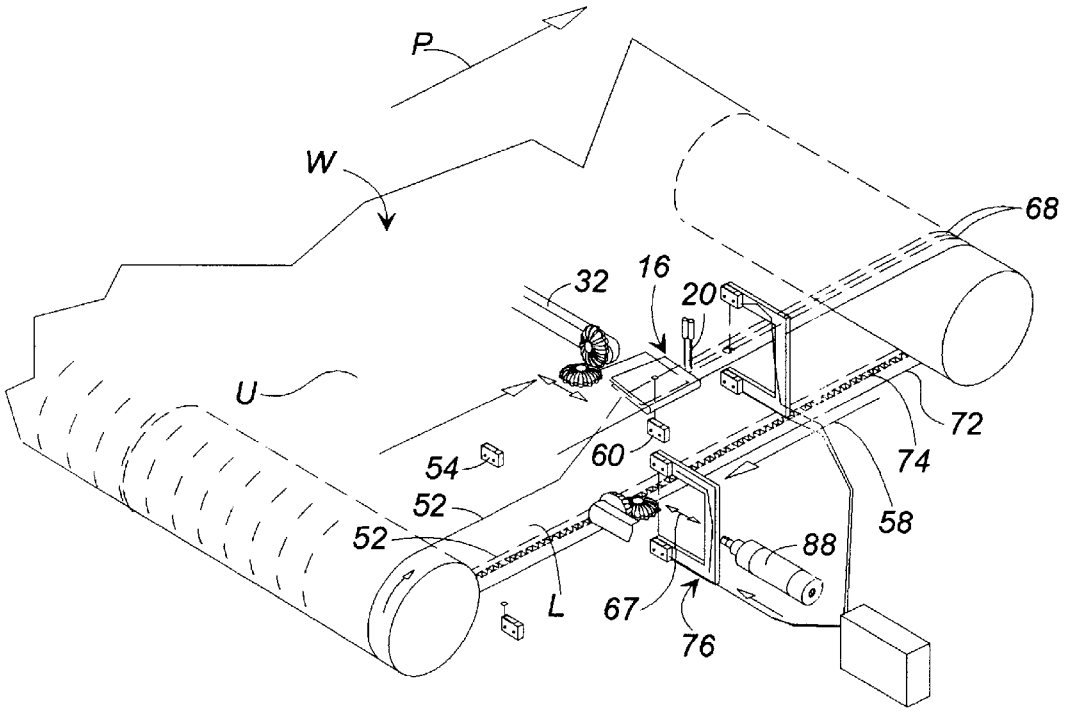
FIG. 7 is a third schematic perspective illustration, similar to FIGS. 5 and 6, but showing the sewn hem being advanced along the processing path past the first opposed beam sensor, and showing the shifting of the first opposed beam sensor to a position where it now detects the hidden raw edge of the folded hem.

Turning next to FIG. 7, the position of the lower opposed beam sensor 76 is illustrated after it has been shifted by pneumatic cylinder 88 so that the beam emitted by beam emitter 82 is in alignment with the "hidden" raw edge 52 of the folded hem. As this occurs, folded raw edge detector 60 continues to control the depth of the hem being formed by the folder assembly 16 as the hem approaches the needles 20 of the sewing machine. Also, during this phase of the sewing cycle, the upper ply sensing opposed beam sensor 78 is inoperative.

Figure 8:
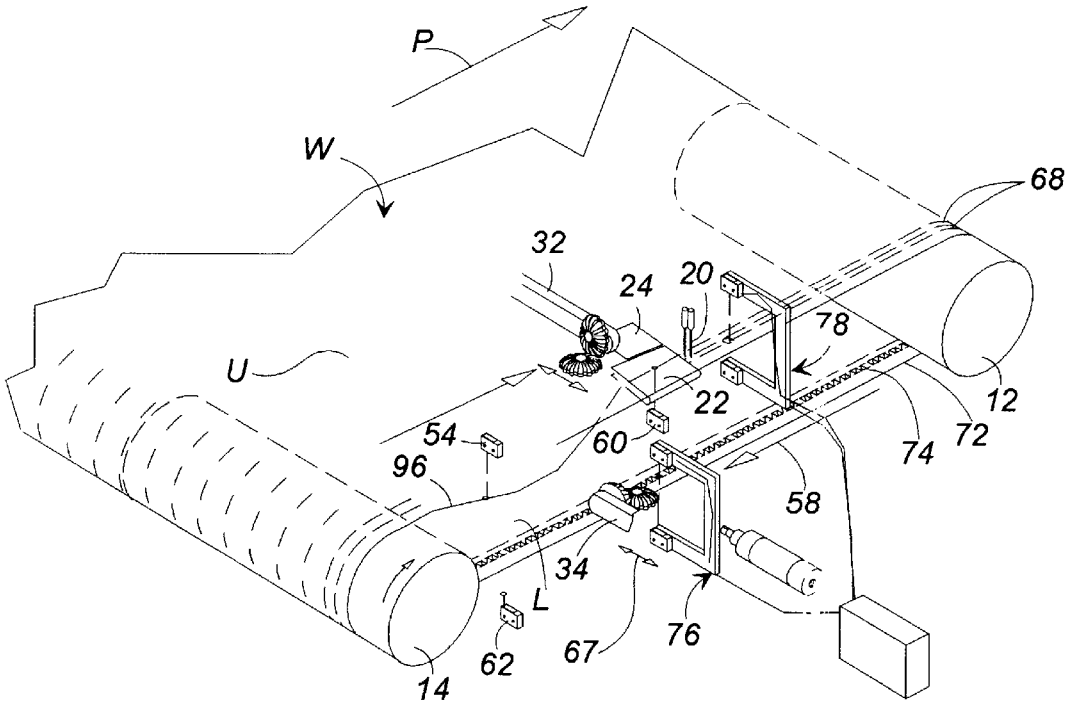
FIG. 8 is a fourth schematic perspective illustration, similar to FIGS. 5–7, but showing the leading edge of the partially completed hem approaching the sewing machine.

Lastly, as shown in FIG. 8, when the raw edge of the unfolded work piece passes beyond raw edge detector 54, the detector senses a "light" condition whereupon folder tongue 24 is retracted from the U-shaped guide 22 of the folder assembly in response thereto, which allows the oncoming stitch lines 68 to pass to sewing needles 20. This allows the hem to be finished while the lower ply sensing opposed beam sensor 76 and the lower work piece guide assembly 34 maintain the hidden raw edge of the folded hem in alignment with the folded edge of the sewn hem so that the needles of the sewing machine will form stitches at the end of the sewing cycle which are in substantial alignment with the oncoming stitches that were formed at the beginning of the sewing cycle. Also, if the folded raw edge detector has been adjusted so that it is in its proper position, the raw edge of the work piece will be straddled by a pair of needles 20 such that one of the parallel lines of stitches 68 will be on one side of the raw edge, and the other parallel line of stitches 68 will be on the opposite side of the raw edge with the crossover stitches 74 spanning across the raw edge and covering the raw edge.

By detecting the hidden raw edge 52 of the sewn hem with the lower opposed beam sensor 76, and guiding the hem with the lower work piece edge guide assembly 34 in response to the control signal emitted by amplifier 92 to central processing unit 96, and from central processing unit 96 to edge guide assembly 34, the lines of stitching 68 formed in the work piece by the sewing needles at the end of the sewing cycle should be closely, if not perfectly, aligned with the lines of stitching so formed at the beginning of the run.

Although the term "raw edge" has been used to describe the unfinished edge of the continuous waste edge of a knitted shirt, for example, it is understood by those skilled in the art that this term is used broadly to describe the edge of a textile work piece that is folded over onto, or otherwise superimposed on, an adjacent body portion of the textile work piece to form a hem. The edge that is being detected can, for example, be unfinished, finished, or even a fold. Moreover, although the disclosed embodiment of the invention illustrates a system for guiding a single raw edge of the material folded onto an adjacent body portion of a work piece to form a two-ply hem, it is understood by those of skill in the art that the hem can include multiple plies of material such that the folded hem may be comprised of not only two, but three or more plies of material.

In addition, it will be understood by those of skill in the art that the opposed beam sensor arrays used to control the position and feeding of the work piece through bottom hemmer 10, and the method of calibrating amplifier 92, and the control of this system based upon differing light conditions, have application and utility in other types of manufacturing processes. Thus, while the above-described opposing beam sensor array, amplifier, central processing unit, and method of calibrating and operating the amplifier have been disclosed with reference to the embodiments disclosed herein in terms of forming a sewn hem in a textile work piece, it is understood by those skilled in the art that this invention can likewise be applied to other manufacturing processes including, but not limited to, filling substantially translucent containers such as shampoo bottles, beverage containers, or other similar containers, as well as for finishing other types of textile fabric articles.

For example, the opposed beam sensors can be placed along a manufacturing line with the first opposed beam sensor positioned to read an empty container and thus calibrate a "light" condition in an amplifier in response thereto. A second opposed beam sensor can be positioned in a downstream location so as to detect the light beams emitted through a now filled container, or in a container being filled in order to set the amplifier to a "dark" condition. After the dark condition has been transmitted and calibrated in the system amplifier, the control relay will be switched back to the first sensor so that the amplifier will receive the readings from the first opposed beam sensor which is now moved to the desired fill level. When the first opposed beam sensor thus detects a condition that is read by the amplifier as being the dark condition, the system knows that the container is filled to the proper level, and will cease filling the container which can then be transported away for further processing or shipment.

It will thus be understood that the use of the opposed beam sensors for control of a manufacturing process, such as for sewing textile articles or filling containers, the calibrating of the amplifier or amplifiers of the system to detect first and second light conditions for controlling the process, is not limited solely to the embodiment disclosed hereinabove, but rather will be understood as having utility in the application and a variety of other applications and processes.

While preferred embodiments of the invention have been disclosed in the foregoing specification, it is understood by those skilled in the art that variations and modifications thereof can be made without departing from the spirit and scope of the invention, as set forth in the following claims. Moreover, the corresponding structures, materials, acts, and equivalents of all means or step plus function elements in the claims are intended to include any structure, material, or acts for performing the functions in combination with other claimed elements, as specifically claimed herein.

We claim:

1. A method of guiding a free edge of a substantially translucent work piece, the work piece having a first ply and a second ply superimposed thereon by folding an edge portion onto an adjacent body portion, the edge portion being adjacent the free edge, to form a folded hem in the work piece as the work piece is advanced along a processing path extending parallel to the free edge of the work piece, said method comprising the steps of:

a) directing a first beam of light through the first ply of the work piece;

b) detecting said beam of light and establishing a first light condition in response thereto;

c) directing a second beam of light through first and second overlapped plies of the work piece;

d) detecting said second beam of light and establishing a second light condition in response thereto;

e) directing said first beam of light through the work piece with respect to the position of the free edge of the work piece; and f) detecting said first light beam through the work piece with respect to said free edge and adjusting the position of the free edge of the work piece laterally of the processing path as the work piece advances along the processing path in response to the detection of said first and said second light conditions through the work piece.

2. The method of claim 1, further including the step of repeating steps a) through f) for each additional work piece advanced along the processing path.

3. A method of forming a folded hem in an edge of a textile work piece with the work piece having a continuous raw edge, an edge portion adjacent its raw edge, and a body portion adjacent its edge portion, said method comprising the steps of:

a) advancing the work piece in an unfolded configuration along a continuous processing path through a sewing machine;

b) detecting an unfolded raw edge of the work piece as the work piece is advanced along said processing path;

c) adjusting the position of the raw edge laterally of the processing path in response the detection in step b) to maintain alignment of the raw edge along the processing path;

d) progressively folding the edge portion of the work piece onto the adjacent body portion prior to moving the edge portion and the adjacent body portion into the sewing machine;

e) progressively sewing the edge portion to the adjacent body portion at the raw edge of the work piece with the sewing machine to form a hem in the work piece;

f) advancing a leading portion of the hem along said processing path toward the sewing machine;

g) detecting the raw edge of a completed portion of the hem as the leading portion of the hem continues to advance toward the sewing station; and h) adjusting the position of the hem laterally of the processing path in response to the detection in step g) to maintain the alignment of the hem along said processing path as the completed portion of the hem approaches the sewing machine.

4. The method of claim 3, wherein step g) of detecting the raw edge of the completed portion of the hem comprises the step of emitting light through the work piece at the completed portion of the hem and detecting changes in light intensity emitted therethrough when the raw edge of the hem alternately obscures and permits the emission of light through the work piece.

5. The method of claim 4, wherein the step of detecting the raw edge of the completed portion of the hem comprises the steps of:

detecting the intensity of light emitted through the edge portion and the adjacent body portion of the folded hem of the work piece in the completed portion of the hem;

detecting the intensity of light emitted through the unfolded work piece; and comparing the intensities of the light emitted through the folded and unfolded work piece.

6. A hem forming assembly for forming a folded hem sewn into a textile work piece having a continuous raw edge, an edge portion adjacent the raw edge, and a body portion adjacent the edge portion, said assembly comprising:

a sewing machine;

drive means for advancing the edge portion and the adjacent body portion of the work piece along a continuous processing path through said sewing machine;

a folder assembly positioned along said processing path upstream of said sewing machine, said folder assembly being constructed and arranged to progressively fold the edge portion of the work piece over onto the adjacent body portion of the work piece as the work piece approaches the sewing machine;

a raw edge detector positioned along the processing path upstream of said folder, said raw edge detector including at least one sensor for detecting the light emitted through plies of the work piece to detect a change in intensity of the light emitted through the work piece to detect the raw edge of the folded work piece; and edge guide means positioned along said processing path upstream of said sewing machine, said edge guide means being responsive to said raw edge detector and being constructed and arranged to laterally adjust the edge portion of the work piece with respect to the length of the work piece as it moves along the processing path.

7. A method of guiding a hidden edge formed as a part of a hem sewn into a translucent textile work piece moving toward a finishing station, and for finishing the work piece, said method comprising the steps of:

a) placing a raw edge of a first ply of a work piece onto at least a second ply of the work piece to form a multiple ply work piece;

b) displacing said raw edge from an edge portion of the work piece so that said raw edge is spaced from and parallel to said edge portion;

c) advancing the work piece along a processing path extending parallel to said raw edge toward a downstream finishing station;

d) emitting light through said first ply and the multiple plies of the work piece;

e) comparing the intensity of light emitted through the first ply and the multiple plies of the work piece;

f) adjusting the position of the work piece laterally of the processing path to maintain the alignment of the raw edge with the edge portion of the work piece, said step further comprising the steps of:

urging the work piece in a first lateral direction in response to detecting light through the multiple plies of the work piece with respect to said raw edge;

urging the work piece in the opposite lateral direction in response to detecting light through the single ply of the work piece with respect to said raw edge;

g) advancing the work piece into the finishing station; and h) finishing the work piece at the finishing station.

8. An apparatus for forming a folded and sewn work piece, the work piece having a raw edge, an edge portion adjacent the raw edge, and a body portion adjacent the edge portion, said apparatus comprising:

a sewing machine for sewing through the work piece;

work piece advancing means adapted to advance the work piece parallel to the raw edge of the work piece along a processing path;

a folder assembly positioned along said processing path upstream of said sewing machine for folding the raw edge and the edge portion of the work piece onto the adjacent body portion of the work piece;

optical sensing means positioned along said processing path, said optical sensing means being constructed and arranged to:

i) direct light through the work piece;

ii) detect the light emitted through multiple plies of the work piece when in a folded configuration;

iii) detect the light emitted through a lesser number of plies of the work piece when in an unfolded configuration;

iv) compare the emissions of light emitted through the work piece and detected thereby; and v) adjust to different intensities of light emission through work pieces of different opacity; and a work piece guide positioned along said processing path responsive to said optical sensing means, said work piece guide being constructed and arranged to adjust the lateral position of the work piece in a first lateral direction when said optical sensing means detects light emitted through the folded portion of the work piece, and to adjust the lateral position of the work piece in a second opposite lateral direction when said optical sensing means detects light emitted through the unfolded portion of the work piece.

9. The apparatus of claim 8, wherein the work piece includes a continuous looped raw edge, and said work piece advancing means comprises a pair of spaced and parallel elongate rotary spindles constructed and arranged to receive and advance the raw edge, the edge portion, and the adjacent body portion of the work piece in a stretched condition thereabout and through said sewing machine, and an idler roller urged toward one of said spindles for holding the work piece in engagement with said one of said spindles.

10. The apparatus of claim 8, wherein:

said work piece advancing means comprises means for advancing the work piece through a continuous closed loop processing path in which the work piece advances from upstream of said folder assembly, through said folder assembly, through said sewing machine, and continues downstream of said sewing machine;

said optical sensing means comprising a spaced pair of optical beam detectors straddling the processing path;

a first one of said optical beam detectors being positioned along the processing path downstream of said sewing machine and being constructed and arranged to detect the multiple plies of the fold of the work piece after the work piece has been advanced through said folder assembly and has been folded thereby;

a second one of said detectors being positioned along the processing path upstream of said folder assembly and being constructed and arranged to detect the single ply of the unfolded work piece before the work piece has been advanced through said folder assembly as the work piece advances in an unfolded configuration toward said folder assembly, and later to detect the multiple plies of the fold of the work piece after the work piece has been folded and sewn as the fold advances along the processing path toward the sewing machine.

11. A method of processing a work product having a first translucent object and at least a second translucent object as a series of the work products are moved along a processing path, said method comprising the steps of:

a) advancing a series of the work products along the processing path;

b) directing a light of a predetermined intensity through the second translucent object of a work product;

c) detecting the intensity of the light emitted through the second translucent object of the work product;

d) directing light of substantially the same intensity as the first said directed light through both the first and second translucent objects of the work product;

e) detecting the intensity of light emitted through both the first and second objects of the work product;

f) comparing the intensities of said first detection of light with said second detection of light;

g) setting a control light intensity at a level between the detected intensities;

h) treating the work product with a first process in response to the detection of light emitted through the first and second objects of the work product being lower than the control light intensity; and i) treating the work product with a second process in response to the detection of light through the work product being higher than the control light intensity.

12. The method of claim 11, and wherein the step of detecting the intensity of light through both the first and second objects comprises the step of measuring the intensity of light at an edge of the first object of the work product with respect to the second object to detect the edge of the first object.

13. The method of claim 12, and wherein the step of advancing the detected edge of the work product comprises the step of advancing the work product along the processing path in a direction parallel to its detected edge.

14. A method of controlling work pieces moving along a processing path, said method comprising the steps of:

a) moving each work piece along the processing path;

b) sensing a first light condition through each work piece;

c) after the first light condition for each work piece has been detected, sensing a second light condition through each work piece to calibrate a system for controlling the work piece with first and second light conditions for each work piece moved along the processing path;

d) monitoring each work piece for its first and said second light conditions as each work piece continues to move along the processing path; and e) controlling each work piece in response to changes in the light condition through each work piece.

15. The method of claim 14, wherein the step of sensing said first light condition includes the step of engaging a first light detector constructed and arranged to detect said first light condition through the work piece, and the step of sensing said second light condition includes the step of engaging a second light detector constructed and arranged to detect said second light condition after the first light condition has been detected.

16. The method of claim 15, further including the steps of:

transmitting the light condition detected by the first light detector to an amplifier means;

switching to the second light detector;

transmitting the light condition detected by the second light detector to the amplifier means; and switching to the first light detector to monitor the work piece for the second light condition as the work piece moves along the processing path.

17. A method of guiding a free edge of a multiple ply hem formed in a translucent work piece as the work piece advances along a processing path extending parallel to the free edge of the work piece, the free edge being adjacent an edge portion, the edge portion being adjacent a body portion of the work piece, said method comprising the steps of:

a) emitting a first light beam toward a first ply of the work piece with a first light beam emitting device;

b) detecting said first light beam through the first ply of the work piece with a first light beam sensor;

c) establishing a first light condition in response thereto;

d) folding a second ply over onto the first ply of the work piece as the work piece advances along the processing path to form the hem in the work piece;

e) emitting a second light beam toward the overlapped plies of the work piece with a second light beam emitting device;

f) detecting said second light beam through the overlapped plies of the work piece with a second light beam sensor;

g) establishing a second light condition in response thereto;

h) moving said first light beam emitting device and said first light beam sensor toward the free edge of the hem along the overlapped second ply of the work piece;

i) detecting said first and said second light conditions, respectively, at the free edge of the work piece with said first light beam sensor; and j) adjusting the position of the free edge laterally with respect to the processing path as the work piece advances therealong in response to detecting said first and said second light conditions.

18. The method of claim 17, step j) further comprising the step of aligning the free edge of the work piece with a downstream work station positioned along the processing path in response to adjusting the position of the free edge of the work piece laterally with respect to the processing path as the work piece advances along the processing path.

19. A system for guiding a multiple ply seam of a work piece, the work piece having a body portion, an edge portion adjacent the body portion, and a free edge adjacent the edge portion extending along the multiple ply seam, the work piece being advanced in the direction of a continuous processing path, said system comprising:

a) a first opposed beam sensor positioned along the processing path with respect to the work piece, said first sensor being constructed and arranged for movement laterally with respect to the processing path from a first position to a spaced second position;

b) a second opposed beam sensor positioned along the processing path with respect to the work piece, said second sensor being spaced from said first sensor;

c) each said sensor being constructed and arranged to emit a beam of light, to detect said beam of light, and to emit a signal of the light intensity of said beam of light so detected;

d) a sensor select relay in communication with each said sensor, said relay being constructed and arranged to selectively receive the light intensity signal of each said sensor;

e) a sensor amplifier in communication with said sensor, said amplifier being constructed and arranged to receive and measure the respective light intensity signals passed on to the amplifier through the relay;

f) a system controller, said controller having a central processing unit in communication with the relay for selecting which of the respective light intensity signals the relay will selectively pass on to the amplifier, said central processing unit also being in communication with the amplifier and being constructed and arranged to instruct the amplifier to selectively measure and internally store a first light condition and a different second light condition to calibrate the amplifier, said amplifier being constructed and arranged to then emit a light intensity control signal to the central processing unit for operating the system in response to the detection of said first and said second light intensities, respectively, by the amplifier.

20. The system of claim 19, wherein said central processing unit signals the relay to selectively pass the light intensity signal emitted from the first sensor to the amplifier to set the first light condition within the amplifier, the central processing unit then signaling the relay to selectively pass the light intensity signal emitted from the second sensor to the amplifier to set the second light condition within the amplifier.

21. The system of claim 20, wherein said central processing unit is constructed and arranged to signal the first sensor to move from its first to its second position with respect to the processing path after the amplifier has been calibrated, and signals the relay to pass only the light intensity signal emitted from the first sensor to the amplifier and to emit said light intensity control signal from the amplifier to the central processing unit.

22. The system of claim 21, further comprising at least one edge guide positioned along the processing path with respect to the work piece, said at least one edge guide being constructed and arranged to laterally adjust the position of the free edge of the work piece with respect to the processing path for aligning the edge portion of the work piece with a work station positioned downstream of said at least one edge guide and along the processing path.

23. The system of claim 22, wherein said at least one edge guide is constructed and arranged to be moved laterally with respect to the processing path in response to the central processing unit's receipt of the light intensity control signal from the amplifier.

* * * * *